US006484809B1

(12) United States Patent
Elder

(10) Patent No.: US 6,484,809 B1
(45) Date of Patent: Nov. 26, 2002

(54) MOLDED SPRINKLER COVER ASSEMBLY AND METHOD FOR MANUFACTURING THE SAME

(75) Inventor: Jack E. Elder, Rochester, MI (US)

(73) Assignee: Innatech, LLC, Rochester, MI (US)

( * ) Notice: Subject to any disclaimer, the term of this patent is extended or adjusted under 35 U.S.C. 154(b) by 0 days.

(21) Appl. No.: 09/567,683

(22) Filed: May 9, 2000

(51) Int. Cl.[7] ..... A62C 37/08
(52) U.S. Cl. ..... 169/37; 169/57; 169/42
(58) Field of Search ..... 169/37, 57, 56, 169/42, 41; 49/1, 3, 7; 428/346

(56) References Cited

U.S. PATENT DOCUMENTS 3,998,273 A * 12/1976 Juliano ..... 169/37
4,014,388 A 3/1977 Anderson
4,596,289 A * 6/1986 Johnson ..... 169/37
4,706,759 A * 11/1987 Grasseschi ..... 169/42
4,830,118 A 5/1989 Capasso
4,976,320 A 12/1990 Polan
5,020,601 A * 6/1991 Retzloff et al. ..... 169/37
5,094,298 A 3/1992 Polan
5,097,906 A 3/1992 Polan
5,213,542 A * 5/1993 Kelly ..... 49/7
5,503,231 A * 4/1996 Palmatier ..... 169/57
5,649,598 A 7/1997 MacDonald, III

* cited by examiner

*Primary Examiner*—John Kwon
*Assistant Examiner*—Dinh Q. Nguyen
(74) *Attorney, Agent, or Firm*—Maginot, Moore & Bowman

(57) ABSTRACT

A sprinkler cover assembly includes a polymeric sprinkler housing which is configured to receive a sprinkler head. The sprinkler cover assembly also includes a polymeric cover for covering an open end of the polymeric sprinkler housing. Moreover, the sprinkler cover assembly includes a thermoreactive adhesive disposed between the polymeric sprinkler housing and the polymeric cover so as to secure the polymeric cover to the polymeric sprinkler housing.

27 Claims, 10 Drawing Sheets

MOLDED SPRINKLER COVER ASSEMBLY AND METHOD FOR MANUFACTURING THE SAME

FIELD OF THE INVENTION

The present invention relates generally to a sprinkler cover assembly, and more particularly to an injection molded, polymeric sprinkler cover assembly that includes a cover which is secured to a sprinkler housing with a heat sensitive, polymeric adhesive.

BACKGROUND OF THE INVENTION

Most commercial and many residential buildings include a fire sprinkler system which has a number of sprinkler heads mounted in a cosmetic ceiling associated with the building. In the event of a fire within the building, the sprinkler system is actuated thereby causing a fire retarding liquid such as water to be sprayed from the ceiling-mounted sprinkler heads. In order to facilitate placement of the sprinkler heads in the cosmetic ceiling, it is generally necessary to cut a number of access openings into the cosmetic ceiling. Such access openings are not visually appealing thereby reducing the overall aesthetics of the interior of the building.

In an attempt to hide or otherwise conceal both the sprinkler heads and their associated access openings, a number of sprinkler cover assemblies have heretofore been designed. Such heretofore designed sprinkler cover assemblies typically include a stamped metal cover which is secured to a metal sprinkler housing by use of either a low melting temperature solder or a heat deforming metal bracket. In the presence of heat associated with a fire (e.g. 135 degrees Fahrenheit), the solder melts or the metal bracket deforms thereby causing the metal cover to fall away from the metal sprinkler housing thereby exposing the sprinkler head located within the housing. Once exposed, the sprinkler head may be utilized to spray water on the area located thereunder.

Such prior art sprinkler cover assemblies have a number of drawbacks associated therewith. For example, fabrication of known sprinkler cover assemblies is relatively complex. For instance, it is generally necessary to utilize a multi-stage manufacturing process in order to produce the stamped metal components associated with prior art sprinkler cover assemblies. More specifically, a complex stamping process is required to produce the metal sprinkler housing, the metal cover, and in certain designs, the heat deformable metal bracket for securing the cover to the sprinkler housing.

Moreover, in order to be aesthetically pleasing once installed in the cosmetic ceiling of a building, the exposed areas of prior art metal sprinkler cover assemblies must be painted. It should be appreciated that such a required painting process undesirably further increases costs associated with manufacturing prior art sprinkler cover assemblies.

What is needed therefore is a sprinkler cover assembly and method for manufacturing the same which overcomes one or more of the aforementioned drawbacks. What is particularly needed is a sprinkler cover assembly having a structure that eliminates the drawbacks associated with the use of stamped metal components. Such a sprinkler cover assembly would advantageously have reduced cost and complexity of manufacture.

SUMMARY OF THE INVENTION

The present invention fulfills the above stated needs, as well as others, by providing a sprinkler cover assembly which includes a polymeric sprinkler housing which is configured to receive a sprinkler head. A polymeric cover is secured to the sprinkler housing with a thermoreactive adhesive. The thermoreactive adhesive, which softens when exposed to heat, provides a mechanism that facilitates removal of the cover to expose the sprinkler head during a fire. The use of polymeric material allows for straightforward injection molding techniques in the manufacturing of the sprinkler cover assembly of the present invention. The use of such injection molding techniques coupled with the use of a thermoreactive adhesive results in a sprinkler cover assembly having the functionality of prior art sprinkler cover assemblies while eliminating the complexity associated with the multi-stage metal stamping and assembly processes associated with such prior art sprinkler cover assemblies.

In accordance with a first embodiment of the present invention, there is provided a sprinkler cover assembly. The sprinkler cover assembly includes a polymeric sprinkler housing which is configured to receive a sprinkler head. The sprinkler cover assembly also includes a polymeric cover for covering an open end of the polymeric sprinkler housing. Moreover, the sprinkler cover assembly includes a thermoreactive adhesive disposed between the polymeric sprinkler housing and the polymeric cover so as to secure the polymeric cover to the polymeric sprinkler housing.

In accordance with a second embodiment of the present invention, there is provided a method of manufacturing a sprinkler housing assembly. The method includes the step of fabricating a polymeric sprinkler housing which is configured to receive a sprinkler head. The method also includes the step of fabricating a polymeric cover for covering an open end of the polymeric sprinkler housing. Moreover, the method includes the step of disposing a thermoreactive adhesive between the polymeric sprinkler housing and the polymeric cover so as to secure the polymeric cover to the polymeric sprinkler housing.

The present invention thus provides a sprinkler cover assembly having reduced cost and simplicity of manufacture. In particular, the sprinkler cover assembly of the present invention eliminates the need to operate and maintain an expensive, multi-stage stamping operation for fabrication of the sprinkler cover assembly. Elimination of the stamping process reduces the cost and complexity of manufacture associated with the sprinkler cover assembly. In addition, the use of polymeric materials in the construction of the sprinkler housing and the cover eliminates the need to paint the sprinkler cover assembly prior to installation thereof.

The above features and advantages, as well as others, will become readily apparent to those of ordinary skill in the art by reference to the following detailed description and accompanying drawings.

DETAILED DESCRIPTION OF THE INVENTION

Figure 1:
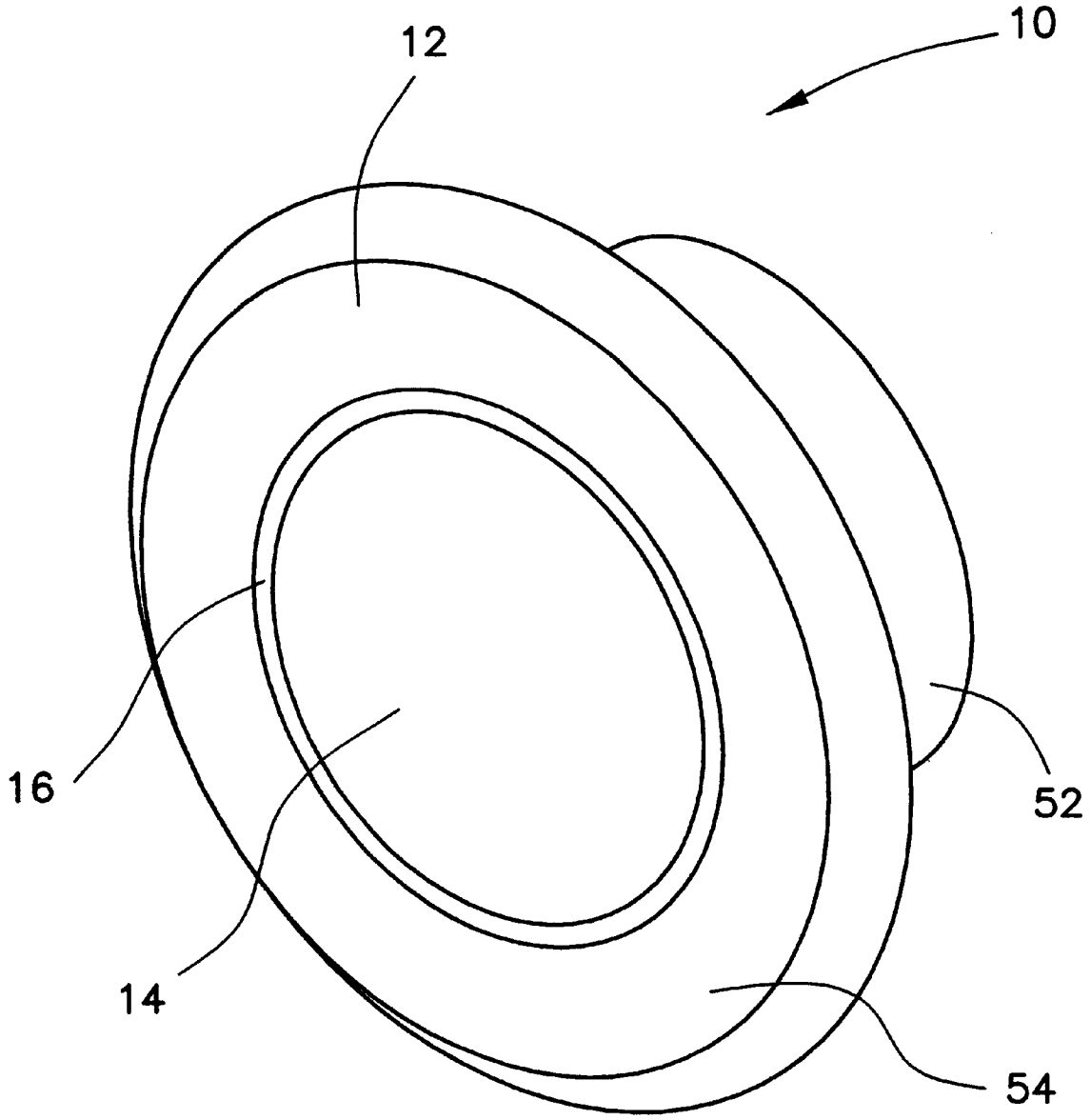
FIG. 1 is a perspective view of a sprinkler cover assembly which incorporates the features of the present invention therein.
Figure 2:
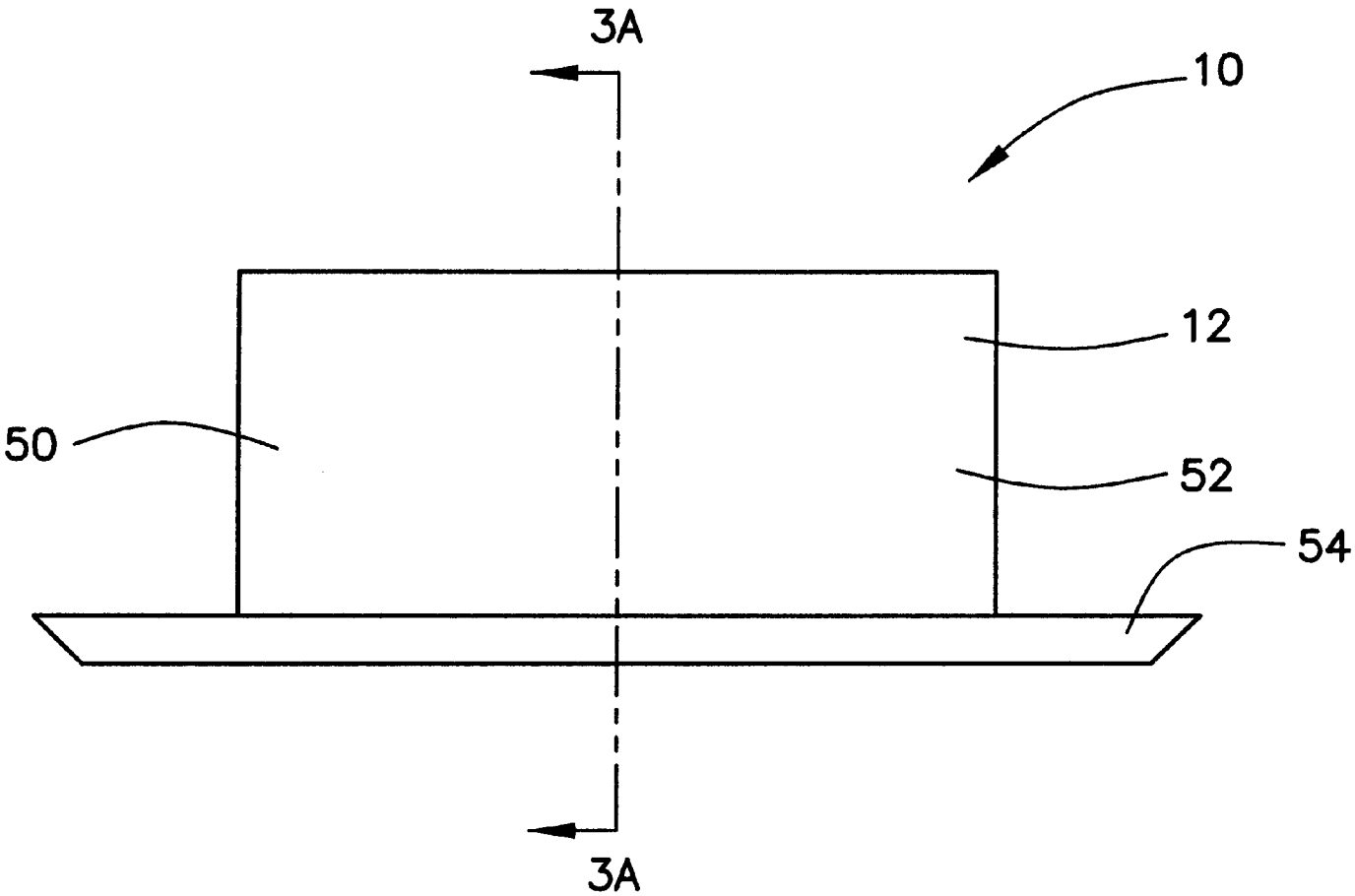
FIG. 2 is a side elevational view of the sprinkler cover assembly FIG. 1.
Figure 3A:
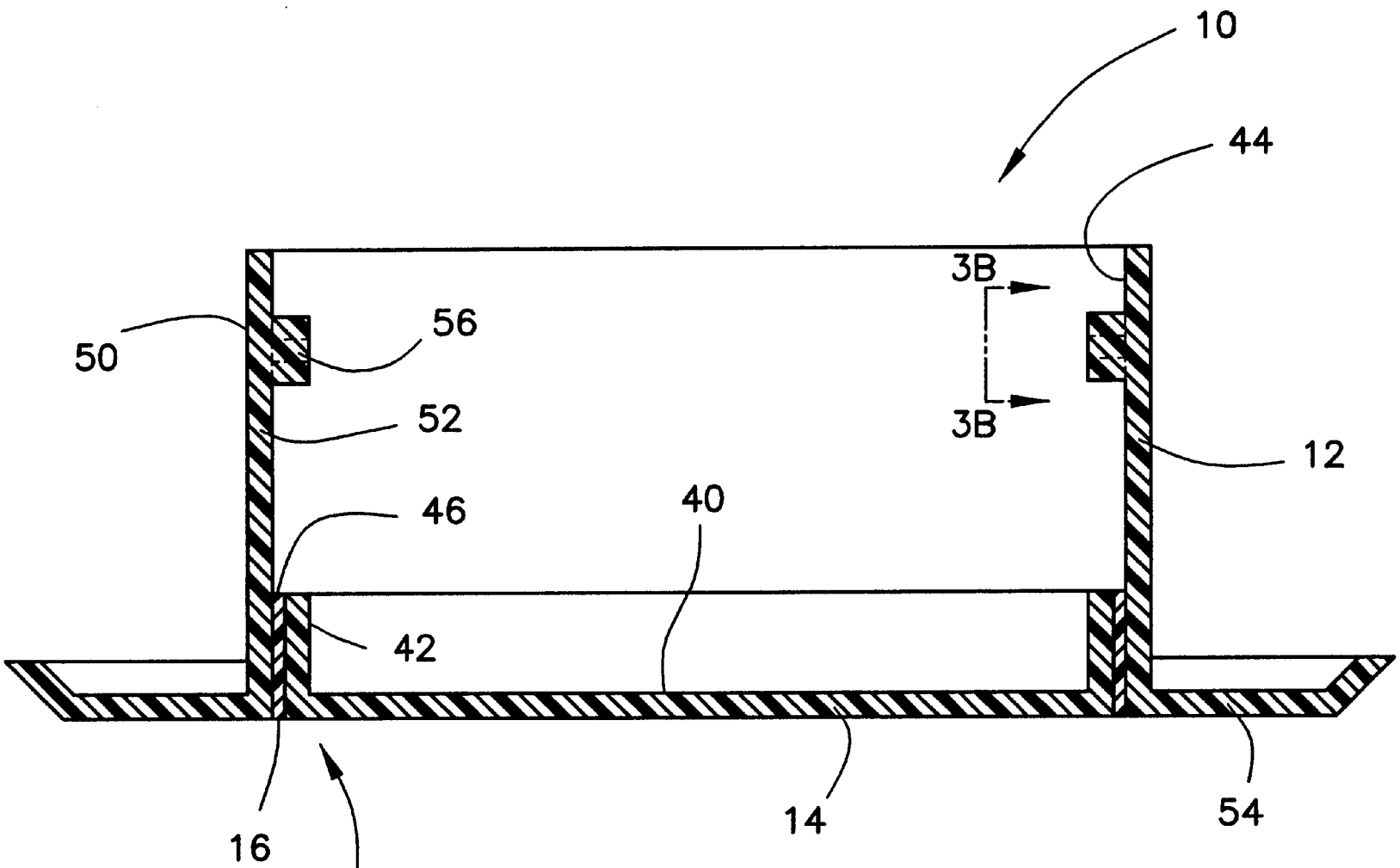
FIG. 3A is a cross sectional view of the sprinkler cover assembly taken along the line 3—3 of FIG. 2, as viewed in the direction of the arrows.
Figure 3B:
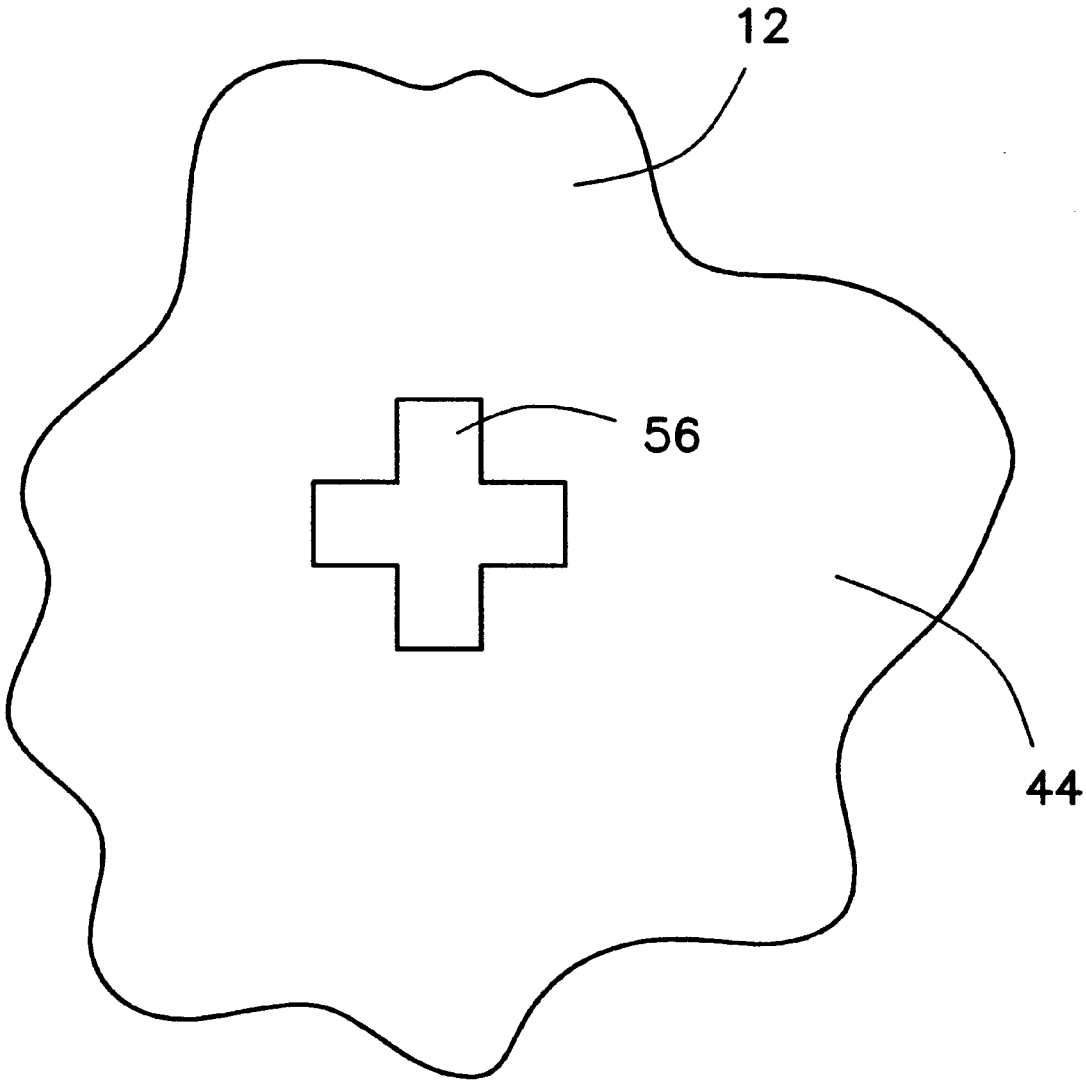
FIG. 3B is an enlarged fragmentary view of the sprinkler cover assembly of FIG. 3A which shows one of the mounting projections in greater detail.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Referring now to FIGS. 1–4, there is shown a sprinkler cover assembly 10 according to the present invention. The sprinkler cover assembly 10 includes a sprinkler housing 12 and a cover 14 with an adhesive 16 disposed therebetween. In general, the sprinkler cover assembly 10 is provided to cover a sprinkler head 18 (see FIG. 4) of a fire sprinkler system thereby enhancing the aesthetic appeal of the building in which the fire sprinkler system is installed. Both the sprinkler housing 12 and the cover 14 are preferably constructed of an injected molded polymeric material such as ABS plastic, nylon material, or styrene. Such an injected molded polymeric material is commonly available in numerous colors and shades thereby allowing the sprinkler housing 12 and the cover 14 to be produced in a wide variety of colors, shades, and textures. Such a feature is particularly useful for reducing costs associated with manufacture of the sprinkler cover assembly 10. In particular, by utilizing polymeric material which possesses the desired color, shade, and texture (e.g. a color, shade, and texture which matches the cosmetic ceiling of the building), the sprinkler housing 12 and the cover 14 do not require subsequent painting thereof prior to installation in the cosmetic ceiling of the building. Such an elimination of the painting process reduces costs associated with manufacture of the sprinkler cover assembly 10 of the present invention.

Figure 5:
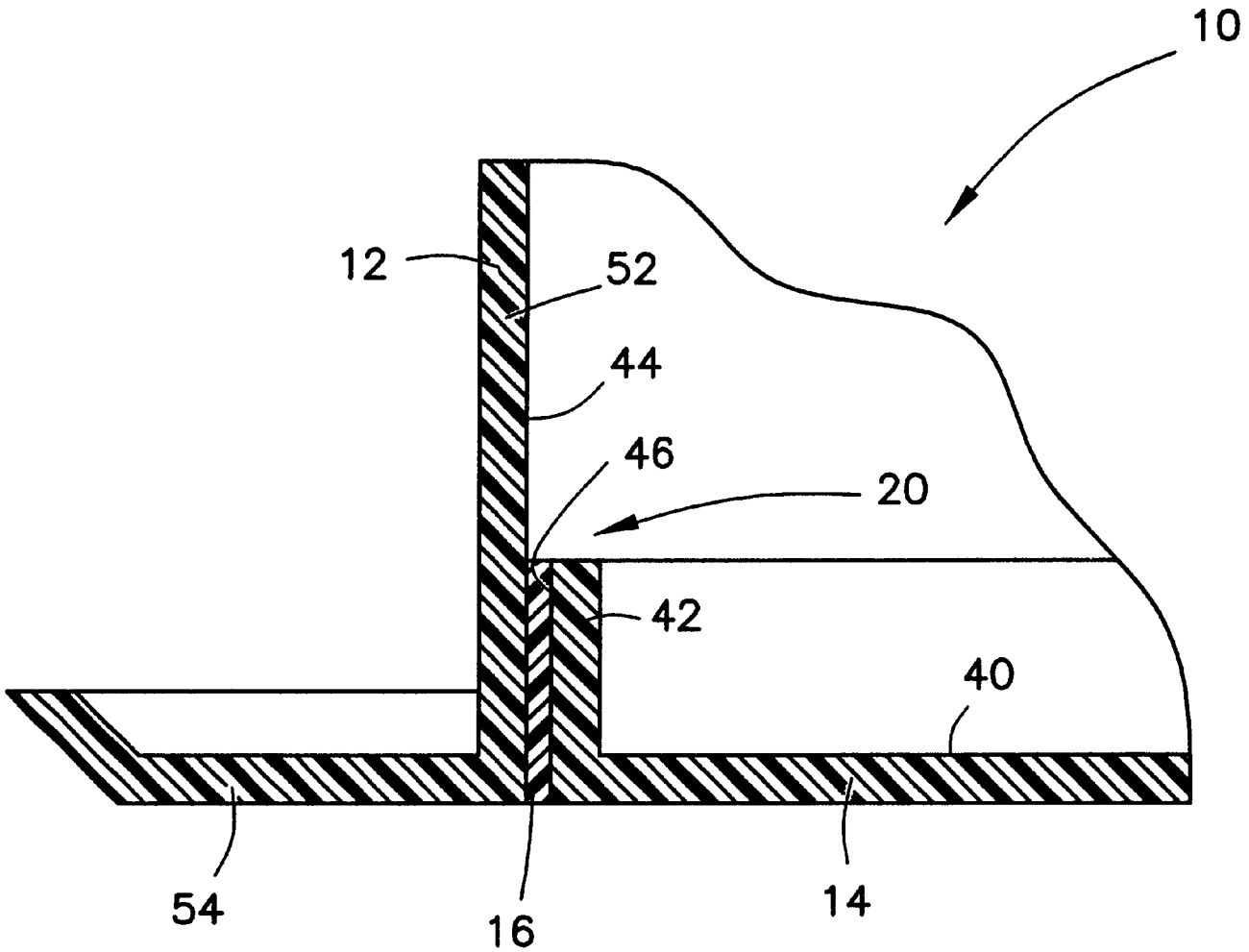
FIG. 5 is an enlarged view of a portion of FIG. 3 which shows the location of the thermoreactive adhesive in greater detail.

As shown in more detail in FIG. 5, the adhesive 16 is disposed between the sprinkler housing 12 and the cover 14. In particular, the cover 14 is preferably cup-shaped and has a bottom surface 40 and a side wall 42 that is substantially perpendicular to the bottom surface 40. In the exemplary embodiment described herein, the side wall 42 forms and annular skirt around a periphery of the bottom surface 40. When secured to the sprinkler housing 12, the side wall 42 is preferably received into the sprinkler housing 12. In particular, when secured to the sprinkler housing 12, the side wall 42 is substantially parallel to or otherwise extends along side at least a portion of an inner wall 44 of sprinkler housing 12. It should be appreciated that such a configuration facilitates ease of fabrication of the sprinkler cover assembly 10. In particular, the adhesive 16 is preferably injected into a gap 46 between the side wall 42 of the cover 14 and the inner wall 44 of sprinkler housing 12 so as to secure the two walls 42, 44 to one another thereby securing the cover to the sprinkler housing 12.

The adhesive 16 is preferably constructed of an injected molded, thermoreactive adhesive material such as a heat sensitive thermoplastic resin. In particular, the adhesive 16 preferably has a predetermined melting temperature which causes the adhesive 16 to soften or otherwise melt when exposed to heat associated with fire. Preferably, the softening point of the adhesive 16 is 130° Fahrenheit, whereas the glass transition temperature of the adhesive 16 (i.e. the temperature at which the adhesive behaves more as a liquid) is preferably between 150° and 160° Fahrenheit. In any event, after the adhesive 16 softens (by being exposed to a temperature above its softening point and preferably above its glass transition point), the cover 14 is configured to fall away or otherwise separate from the sprinkler housing 12 thereby exposing the sprinkler head 18 positioned within the sprinkler housing 12. One injected molded, thermoreactive material which is suitable for use as the adhesive 16 of the present invention is a very low density polyethylene blend such as a polyethylene wax.

Figure 4:
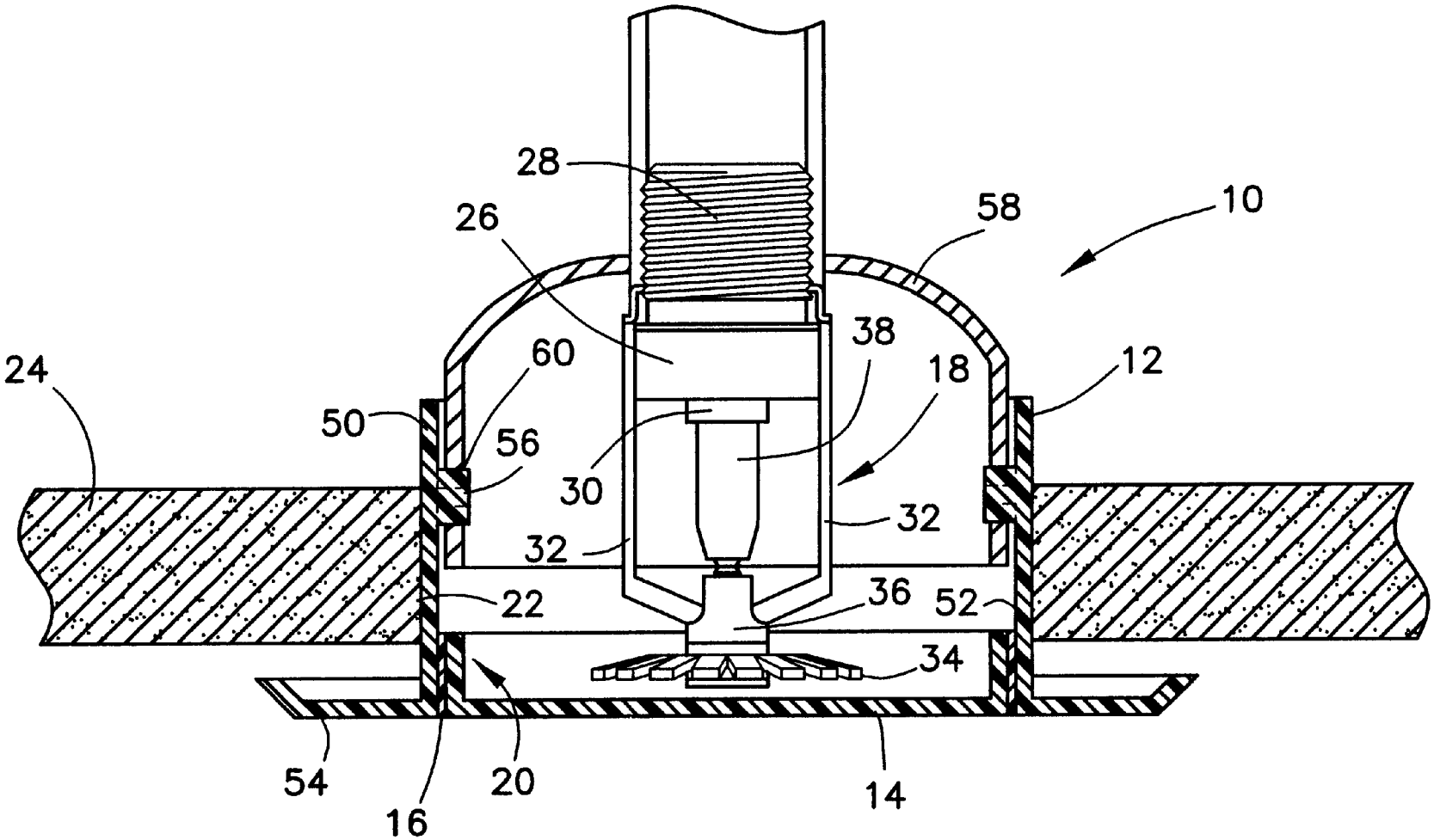
FIG. 4 is a view similar to FIG. 3, but showing the sprinkler cover assembly installed in a cosmetic ceiling so as to cover a sprinkler head, note that the sprinkler head is not shown in cross section for clarity of description.

As shown in FIG. 4, the sprinkler cover assembly 10 covers the sprinkler head 18 so as to conceal the sprinkler head 18 from view within the room. In particular, the sprinkler housing 12 preferably includes a cylindrical portion 52 and a flange portion 54. The cylindrical portion 52 is advantageously configured to receive or otherwise contain the sprinkler head 18. The flange portion 54 extends angularly from the cylindrical portion and is configured to hide or otherwise cover an access opening 22 defined in a ceiling panel 24 of the building's cosmetic ceiling. As described above, such access openings 22 are necessary to accommodate the installation of the sprinkler heads 18. Moreover, the cover 14 is preferably circular in shape and is secured to the sprinkler housing 12 so as to cover an open end 20 of the sprinkler housing 12 thereby preventing a person standing in the room from seeing the sprinkler head 18.

The sprinkler head 18 includes a body 26 having a threaded portion 28 for attachment to a water supply pipe associated with the fire sprinkler system. The body 26 defines a nozzle which is closed by a plug 30. The sprinkler head 18 also includes a pair of arms 32 having a deflector 34 secured to an end portion 36 thereof. The sprinkler head 18 further includes a thermal trigger 38 such as a glass bulb filled with a suitable liquid which, when exposed to heat associated with a fire, expands thereby causing the glass bulb to shatter. When the glass bulb shatters, the plug 30 is released thereby allowing a pressurized fire retarding liquid such as water to be advanced from the body 26 and into contact with the deflector 34 thereby forming a suitable spraying pattern for combating a fire within the room in which the sprinkler head 18 is located. It should be appreciated that the sprinkler head 18 may be configured in any one of a number of known configurations which fit the needs of a given fire sprinkler system. For example, the sprinkler head 18 may be configured to include a spring mechanism (not shown) which causes the deflector 34 to "drop" a short, predetermined distance away from the body 26 thereby positioning the deflector 34 below the plane of the ceiling panel 24 so as to increase the size of the spraying pattern associated with the sprinkler head 18.

As shown in FIG. 4, the sprinkler head 18 has a mounting member 58 secured thereto. The mounting member 58 is provided to secure the sprinkler cover assembly 10 to the sprinkler head 18. In particular, the mounting member 58 has a number of mounting notches 60 defined therein which receive a corresponding number of mounting protrusions 56 defined in the inner wall 44 of the sprinkler housing 12 (see FIG. 3). When the sprinkler housing 12 is secured to the sprinkler head 18, the flange portion 54 is spaced apart a small distance from the ceiling panel 24 so as to provide for heat transfer between the ceiling panel 24 and the sprinkler housing 12.

As discussed above, the cover 14 falls away from the sprinkler housing 12 when the adhesive 16 is heated to its glass transition point, or at least to its softening point. As a result, the sprinkler head 18 becomes exposed. Preferably, the adhesive 16 is selected such that its softening point and glass transition point allow the cover 14 to fall away prior to the temperature at which the thermal trigger 38 actuates the sprinkler head 18. Hence, the cover 14 preferably falls away from the sprinkler housing 12 prior to actuation of the sprinkler head 18 so that the sprinkler head 18 may spray water through the open end 22 of the sprinkler housing 12 without a portion of the stream of water being deflected or otherwise interfered with by the cover 14. However, it will be noted that in certain cases, the cover 14 may not fall away or otherwise separate from the sprinkler housing 12 until the force of the liquid from the sprinkler head 18 acts upon the cover 14. In either event, the softening of the thermoreactive adhesive 16 facilitates the separation of the cover 14 from the sprinkler housing 12.

The method of manufacturing the sprinkler cover assembly 10 of the present invention includes the step of fabricating the polymeric sprinkler housing 12 such that the sprinkler housing 12 is configured to house the sprinkler head 18. The method of manufacturing the sprinkler cover assembly 10 of the present invention also includes the step of fabricating the polymeric cover 14 such that the cover 14 may be utilized to cover the open end 20 of the sprinkler housing 12. Moreover, the method of manufacturing the sprinkler cover assembly 10 of the present invention further includes the step of disposing the polymeric adhesive 16 between the sprinkler housing 12 and the cover 14 so as to secure the cover 14 to the sprinkler housing 12.

One manner of fabricating the sprinkler housing 12 and the cover 14 is by an injection molding process. Moreover, an injection molding process may also be utilized to dispose the adhesive 16 between the sprinkler housing 12 and the cover 14. In this manner, the entire sprinkler cover assembly 10 may be fabricated using an "in-mold assembly" process thereby reducing post-mold fabrication while also increasing the quality of the finished product. In such an in-mold assembly process, the entire sprinkler cover assembly 10 is molded by use of a multiple-material injection molding machine.

Figure 6:
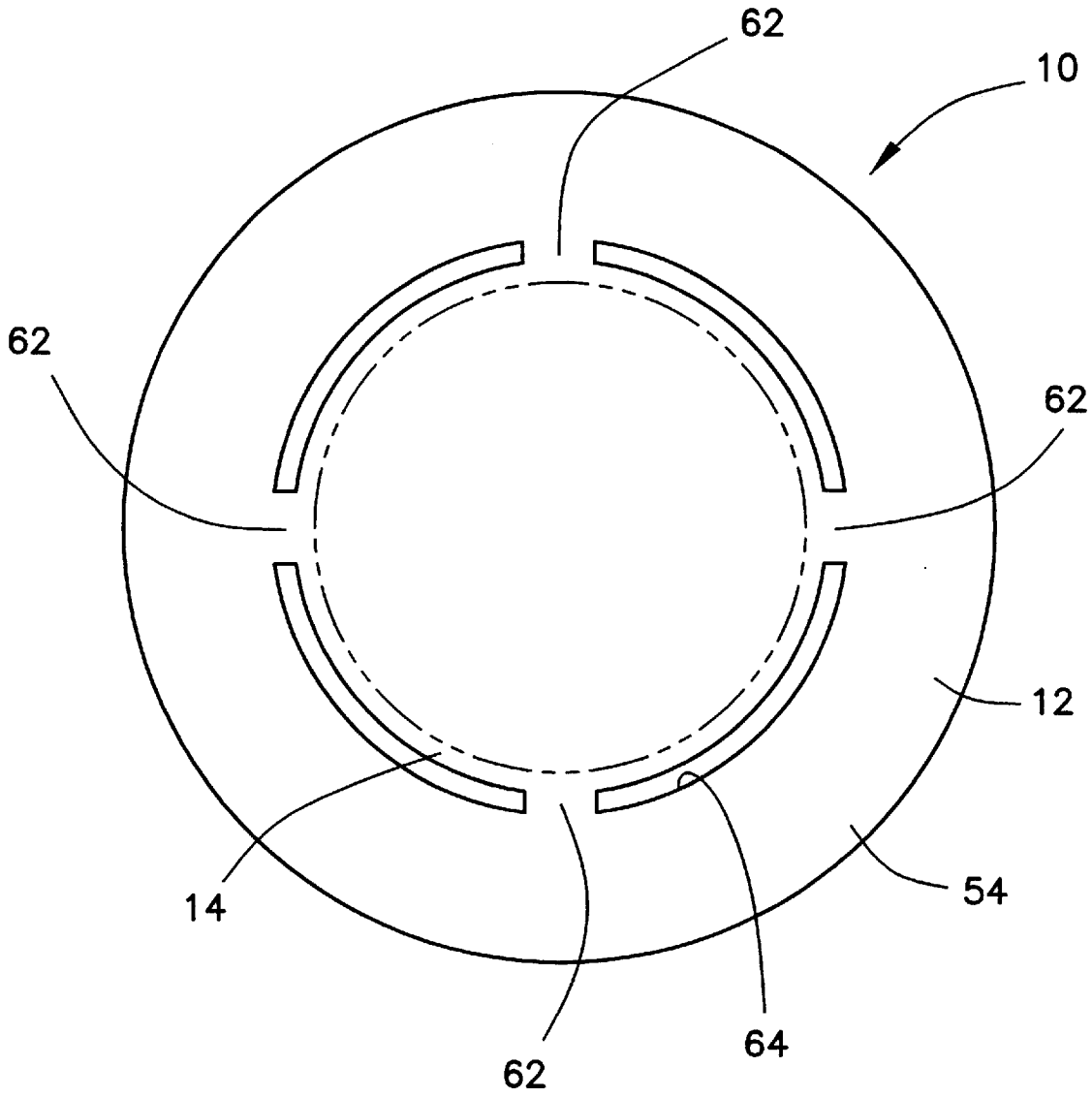
FIG. 6 is a bottom elevational view of the sprinkler cover assembly after a first molding step.

In particular, the sprinkler housing 12 and the cover 14 are first simultaneously injection molded at a first molding station of the molding machine. As described above, the polymeric material utilized in the construction of the sprinkler housing 12 and the cover 14 may be provided in any combination of numerous colors, shades, and textures such that the finished sprinkler cover assembly 10 matches the ceiling panel 24 in which it is installed. As shown in FIG. 6, the mold utilized to mold the sprinkler housing 12 and the cover 14 is configured to mold the housing 12 and the cover 14 as a single piece. To this end, a number of bridges or molding tabs 62 are created between the sprinkler housing 12 and the cover 14 during the molding process. It should be appreciated that the molding tabs 62 secure the sprinkler housing 12 and the cover 14 to one another during advancement to a subsequent molding station within the molding machine during the molding process.

Figure 7:
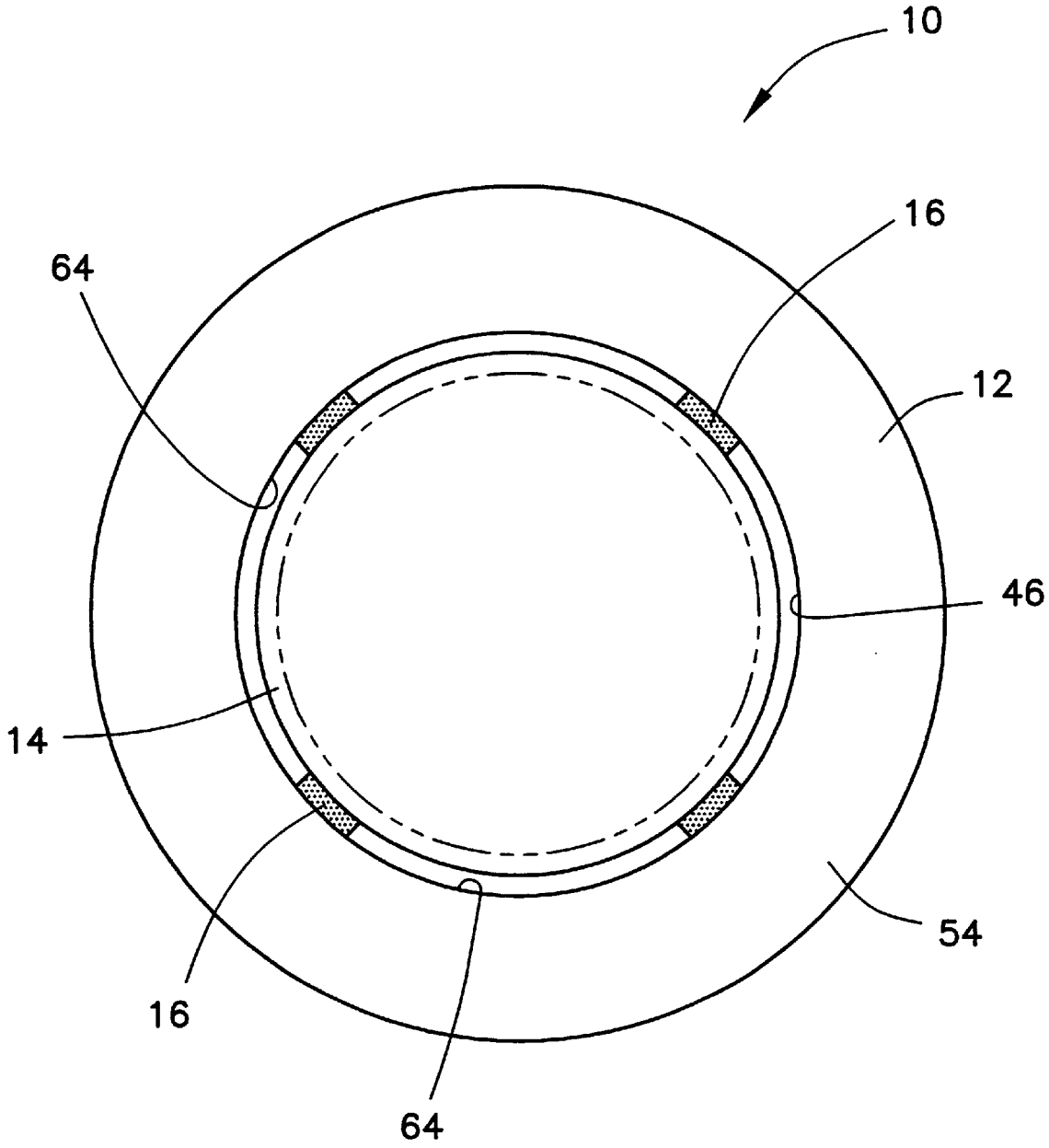
FIG. 7 is a view similar to FIG. 6, but showing the sprinkler cover assembly after a second molding step.

Once the sprinkler housing 12 and the cover 14 have been molded, the adhesive 16 is subsequently injected into the gap 46 between the side wall 42 of the cover 14 and the inner wall 44 of the sprinkler housing 12 at a second molding station of the molding machine. In particular, at the second molding station of the molding machine, a mold tool component (not shown) having a number of steel cutters secured thereto is first lowered onto the assembly consisting of the sprinkler housing 12 and the cover 14. The steel cutters are aligned with the molding tabs 62 and are utilized to cut or otherwise remove the molding tabs 62 as the mold tool component is lowered onto the assembly. The mold tool component is also configured to "mask" certain portions of the gap 46 such that when the adhesive 16 is injected into the gap 46, only certain portions of the gap 46 are filled with adhesive 16, as shown in FIG. 7. The remain portions of the gap 46 define a number of heat transfer openings 64 which are utilized to allow the temperature within the sprinkler housing 12 to be substantially the same as the temperature outside the sprinkler housing 12. It should be appreciated that such a configuration (i.e. the use of the heat transfer openings 64) facilitates actuation of the sprinkler head 18 in the event of a fire by allowing the thermal trigger 38 to be exposed to heat associated with the fire in a timely manner. Once the adhesive 16 has been injected into the gap 46 in the manner described, the finished sprinkler cover assembly 10 is ejected from the molding machine. Hence, a completed sprinkler cover assembly 10 exits the molding machine during every cycle of the machine thereby increasing the efficiency of the manufacturing process.

As described, the method of manufacturing the sprinkler cover assembly 10 has the advantage of reducing the cost and complexity of sprinkler cover assembly manufacturing. In particular, because the method of manufacturing the sprinkler cover assembly 10 of the present invention does not require use of a complex and expensive metal stamping process, the drawbacks associated with heretofore designed sprinkler cover assemblies are eliminated.

Moreover, because the method of manufacturing the sprinkler cover assembly 10 of the present invention does not require an expensive painting process, additional drawbacks associated with prior art sprinkler cover assemblies have also been eliminated. In particular, it should be appreciated that such a painting process associated with prior art sprinkler cover assemblies undesirably increases both the amount of time and cost associated with assembly of the prior art sprinkler cover assemblies.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

Figure 8:
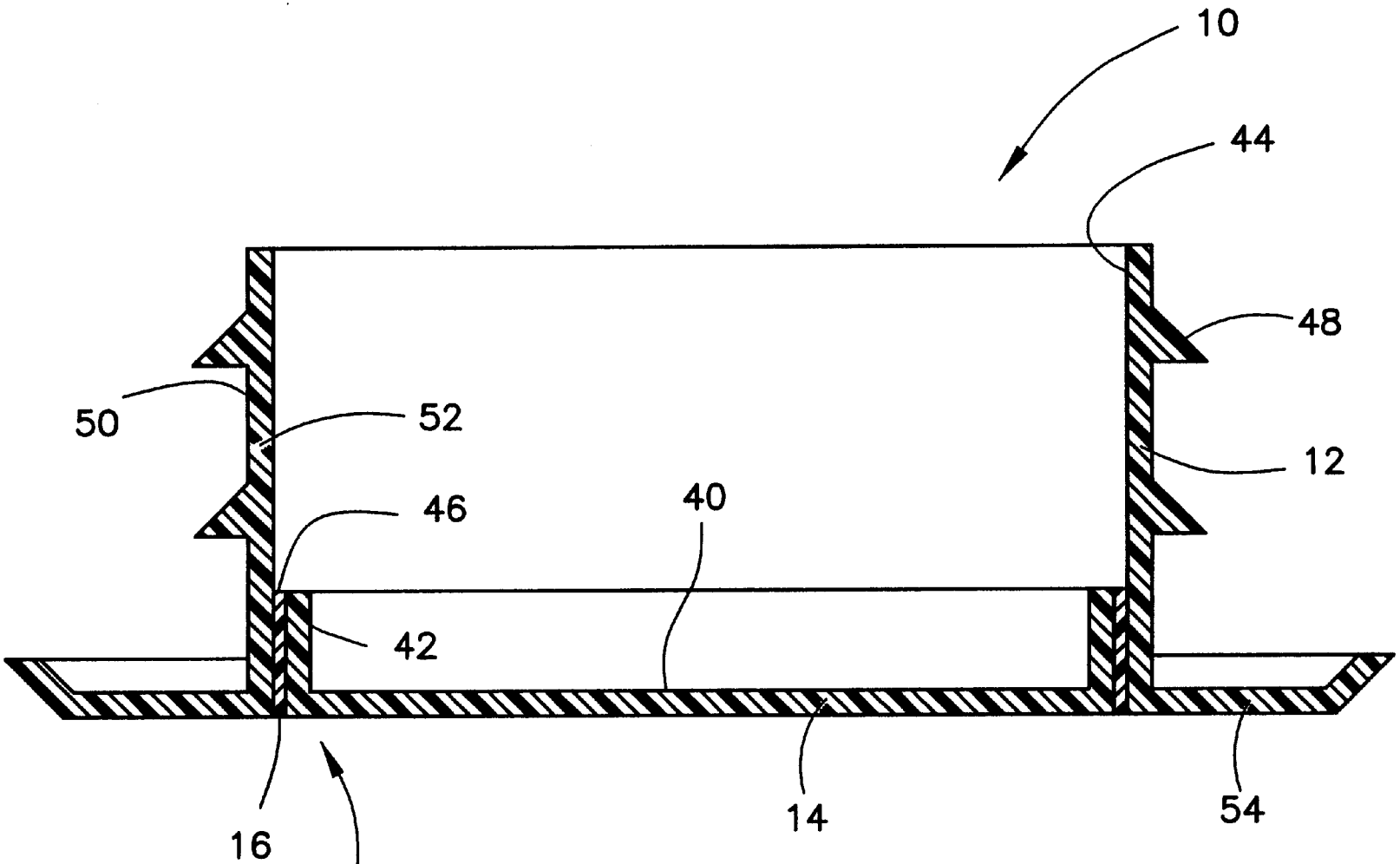
FIG. 8 is a view similar to FIG. 3A, but showing a second embodiment of the sprinkler housing which has a number of barbs secured to the outside thereof.
Figure 9:
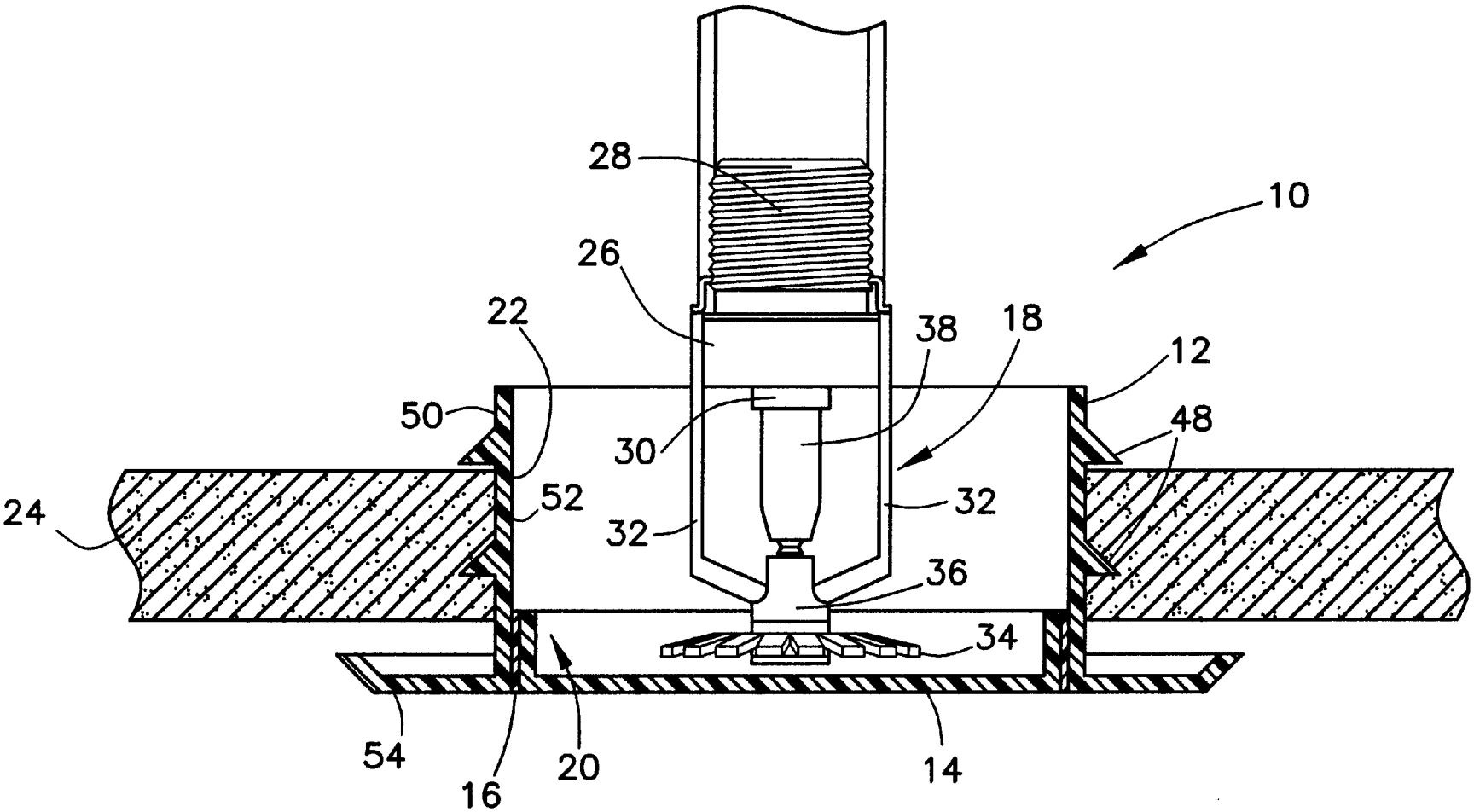
FIG. 9 is a view similar to FIG. 4, but showing the sprinkler cover assembly configured to include the sprinkler housing of FIG. 8.

One modification relates to the manner in which the sprinkler housing 12 is secured into position over the sprinkler head 18. For example, in order to secure the sprinkler cover assembly 10 to the ceiling panel 24, the sprinkler housing 12 may be configured to include a number of barbs 48 defined in an outer surface 50 thereof (see FIGS. 8 and 9) in lieu of the mounting protrusions 56. In particular, the barbs 48 are defined in the outer surface 50 of the cylindrical portion 52 and engage the inner surface of the access opening 22 of the ceiling panel 24 so as to secure the sprinkler housing 12 to the ceiling panel 24. In addition to the barbs 48 and the mounting protrusions 56, those of ordinary skill in the art may readily devise further mechanisms for securing the sprinkler cover assembly 10, including mechanisms that secure the sprinkler cover assembly 10 to either the ceiling structures or the components associated with the fire sprinkler system.

There are a plurality of advantages of the present invention arising from the various features of the sprinkler cover assembly described herein. It will be noted that alternative embodiments of the sprinkler cover assembly of the present invention may not include all of the features described yet still benefit from at least some of the advantages of such features. Those of ordinary skill in the art may readily devise their own implementations of a sprinkler cover assembly that incorporate one or more of the features of the present invention and fall within the spirit and scope of the present invention as defined by the appended claims.

What is claimed is:

1. A sprinkler cover assembly, comprising:

a polymeric sprinkler housing which is configured to receive a sprinkler head;

a polymeric cover for covering an open end of said polymeric sprinkler housing; and a thermoreactive adhesive disposed between said polymeric sprinkler housing and said polymeric cover so as to secure said polymeric cover to said polymeric sprinkler housing.

2. The sprinkler cover assembly of claim 1, wherein:

said thermoreactive adhesive is configured so as to soften when said thermoreactive adhesive is exposed to heat associated with a fire; and said polymeric cover is configured to separate from said polymeric sprinkler housing after said thermoreactive adhesive softens.

3. The sprinkler cover assembly of claim 2, wherein said open end of said polymeric sprinkler housing is configured to permit a fire retarding liquid to be sprayed therethrough when said polymeric cover is separated from said polymeric sprinkler housing.

4. The sprinkler cover assembly of claim 1, wherein:

said polymeric cover includes (i) a bottom surface and (ii) a side wall which is substantially perpendicular to said bottom surface;

said side wall of said polymeric cover is substantially parallel with an inner surface of said polymeric sprinkler housing when said polymeric cover is secured to said polymeric sprinkler housing; and said thermoreactive adhesive is disposed between said side wall of said polymeric cover and said inner surface of said polymeric sprinkler housing.

5. The sprinkler cover assembly of claim 1, wherein:

said polymeric sprinkler housing includes a cylindrical portion; and said polymeric cover is circular in shape.

6. The sprinkler cover assembly of claim 1, wherein:

both said polymeric sprinkler housing and said polymeric cover are constructed of injected molded polymers; and said thermoreactive adhesive comprises an injected molded thermoreactive adhesive.

7. A method of manufacturing a sprinkler housing assembly, comprising the steps of:

fabricating a polymeric sprinkler housing which is configured to receive a sprinkler head;

fabricating a polymeric cover for covering an open end of said polymeric sprinkler housing; and disposing a thermoreactive adhesive between said polymeric sprinkler housing and said polymeric cover so as to secure said polymeric cover to said polymeric sprinkler housing.

8. The method of claim 7, wherein:

said step of fabricating said polymeric sprinkler housing includes the step of injection molding said polymeric sprinkler housing; and said step fabricating said polymeric cover includes the step of injection molding said polymeric cover.

9. The method of claim 8, wherein both said step of injection molding said polymeric sprinkler housing and said step of injection molding said polymeric cover are performed contemporaneously at a first molding station.

10. The method of claim 8, wherein said step of disposing said thermoreactive adhesive includes the step of injection molding said thermoreactive adhesive between said polymeric sprinkler housing and said polymeric cover.

11. The method of claim 10, wherein:

both said step of injection molding said polymeric sprinkler housing and said step of injection molding said polymeric cover are performed contemporaneously at a first molding station; and said step of injection molding said thermoreactive adhesive is performed at a second molding station after both said step of injection molding said polymeric sprinkler housing and said step of injection molding said polymeric cover.

12. The method of claim 7, wherein said step of disposing said thermoreactive adhesive includes the step of disposing said thermoreactive adhesive between said polymeric sprinkler and said polymeric cover such that said thermoreactive adhesive softens after exposure to heat associated with a fire, thereby permitting the polymeric cover to separate from said polymeric housing.

13. The method of claim 7, wherein:

said polymeric cover includes (i) a bottom surface and (ii) a side wall which is substantially perpendicular to said bottom surface;

said polymeric sprinkler housing has an inner surface defined therein; and said step of disposing said thermoreactive adhesive includes the step of injection molding said thermoreactive adhesive between said inner surface of said polymeric sprinkler housing and said side wall of said polymeric cover.

14. A sprinkler cover assembly, comprising:

an injected molded sprinkler housing which is configured to receive a sprinkler head;

an injection molded cover for covering an open end of said injection molded sprinkler housing; and a thermoreactive adhesive disposed between said injection molded sprinkler housing and said injection molded cover so as to secure said injection molded cover to said injection molded sprinkler housing.

15. The sprinkler cover assembly of claim 14, wherein:

said thermoreactive adhesive is configured so as to soften when said thermoreactive adhesive is exposed to heat associated with a fire; and said injection molded cover is configured to separate from said injection molded sprinkler housing after said thermoreactive adhesive softens.

16. The sprinkler cover assembly of claim 15, wherein said open end of said injection molded sprinkler housing is configured to permit a fire retarding liquid to be sprayed therethrough when said injection molded cover is separated from said injection molded sprinkler housing.

17. The sprinkler cover assembly of claim 14, wherein:

said injection molded cover includes (i) a bottom surface and (ii) a side wall which is substantially perpendicular to said bottom surface;

said side wall of said injection molded cover is substantially parallel with an inner surface of said injection molded sprinkler housing when said injection molded cover is secured to said injection molded sprinkler housing; and said thermoreactive adhesive is disposed between said side wall of said injection molded cover and said inner surface of said injection molded sprinkler housing.

18. The sprinkler cover assembly of claim 14, wherein:

said injection molded sprinkler housing includes a cylindrical portion; and said injection molded cover is circular in shape.

19. A sprinkler cover assembly, comprising:

a sprinkler housing which is configured to receive a sprinkler head;

a cover for covering an open end of said sprinkler housing, said cover having (i) a bottom surface, and (ii) a side wall which is substantially perpendicular to said bottom surface, said side wall being received into an open end of said sprinkler housing; and a thermoreactive adhesive disposed between said sprinkler housing and said cover so as to secure said cover to said sprinkler housing.

20. The sprinkler cover assembly of claim 19, wherein:

said side wall of said cover is substantially parallel with an inner surface of said sprinkler housing when said cover is secured to said sprinkler housing; and said thermoreactive adhesive is disposed between said side wall of said cover and said inner surface of said sprinkler housing.

21. The sprinkler cover assembly of claim 19, further comprising a barb for securing said sprinkler housing to a ceiling panel, wherein said barb is secured to an outer surface of said sprinkler housing.

22. The sprinkler cover assembly of 21, wherein said barb is integrally molded with said outer surface of said sprinkler housing.

23. The sprinkler cover assembly of claim 19, wherein:

said thermoreactive adhesive is configured so as to soften when said thermoreactive adhesive is exposed to heat associated with a fire; and said cover is configured to separate from said sprinkler housing after said thermoreactive adhesive softens.

24. The sprinkler cover assembly of claim 19, wherein said open end of said sprinkler housing is configured to permit a fire retarding liquid to be sprayed therethrough when said cover is separated from said sprinkler housing.

25. The sprinkler cover assembly of claim 19, wherein said sprinkler housing comprises a cylindrical portion for receiving said sprinkler head.

26. The sprinkler cover assembly of claim 25, wherein said sprinkler housing further comprises an annular flange extending radially outward of said cylindrical portion.

27. The sprinkler cover assembly of claim 25, wherein said bottom surface of said cover is circular in shape and said side wall forms and annular skirt thereon.

* * * * *